US006460255B1

(12) United States Patent
Dassaud

(10) Patent No.: US 6,460,255 B1
(45) Date of Patent: Oct. 8, 2002

(54) CUTTING INSTRUMENT

(76) Inventor: René Dassaud, Jambost, 63300 Thiers (FR)

( * ) Notice: Subject to any disclaimer, the term of this patent is extended or adjusted under 35 U.S.C. 154(b) by 0 days.

(21) Appl. No.: 09/701,522

(22) PCT Filed: May 26, 1999

(86) PCT No.: PCT/FR99/01222

§ 371 (c)(1),
(2), (4) Date: Nov. 28, 2000

(87) PCT Pub. No.: WO99/62677

PCT Pub. Date: Dec. 9, 1999

(30) Foreign Application Priority Data

May 29, 1998 (FR) ..... 98 06982

(51) Int. Cl.[7] ..... B26B 3/00
(52) U.S. Cl. ..... 30/340; 30/298; D7/652
(58) Field of Search ..... D30/296.1, 298, D30/340; D7/649; D8/DIG. 4

(56) References Cited

U.S. PATENT DOCUMENTS

| | | | | | |
|---|---|---|---|---|---|
| 76,464 | A | * | 4/1868 | Johnson | 30/298 |
| D49,724 | S | * | 10/1916 | Curtiss | D7/652 |
| 2,124,615 | A | * | 7/1938 | Foltz | 30/340 |
| 2,421,339 | A | * | 5/1947 | Leger | 30/340 |
| 3,595,104 | A | | 7/1971 | Cooper | 76/104 |
| D229,472 | S | * | 12/1973 | Collins | D7/649 |
| D250,567 | S | * | 12/1978 | Breger | D7/649 |
| 4,283,854 | A | * | 8/1981 | Austin | 30/340 |
| 4,854,044 | A | * | 8/1989 | Collins | 30/151 |
| 5,490,332 | A | | 2/1996 | Levin | 30/161 |

FOREIGN PATENT DOCUMENTS

| | | |
|---|---|---|
| DE | 4318308 | 10/1993 |
| EP | 0283445 | 9/1988 |
| GB | 2171628 | 9/1986 |
| GB | 2291614 | 1/1996 |

* cited by examiner

*Primary Examiner*—Hwei-Siu Payer
(74) *Attorney, Agent, or Firm*—Wall Marjama & Bilinski LLP

(57) ABSTRACT

A cutting instrument characterized in that the handle has, on the side connecting it to the blade, arrangements providing protection for the user's fingers, with respect to the blade cutting edge; the blade is lowered and inclined with respect to the handle top ridge so as to position the blade cutting edge as close as possible to the work space.

15 Claims, 1 Drawing Sheet

CUTTING INSTRUMENT

BACKGROUND OF THE INVENTION

The invention relates to the technical field of cutting implements of the knife type, comprising a fixed blade integral with a handle.

More particularly, the invention relates to knives for professional use for cutting different kinds of products. A particular example is knives used in the agrofoodstuffs industry, e.g. for slaughtering or cutting up meat or the like. Clearly, knives for household usage for cutting up meat and so forth fall within the scope of the invention.

As is perfectly familiar, the knife has a cutting blade attached to a handle of appropriate ergonomic shape. The blade is usually made of treated stainless steel, while the handle may be made from a variety of different materials, such as wood, plastics etc.

According to the intended application, the blade has different profiles, on the one hand, and different features for making the cut itself, on the other.

In whatever form they are produced, these knives are not as safe as they should be for the user, if one considers certain working conditions. Often the user is obliged not only to exert a downward force to make a cut, but also a pushing force along the handle in order to drive the blade into the product on which he is working. There is thus a serious risk that the hand may, as it applies this pushing force, slide off the handle and onto the cutting edge of the blade. Cuts of greater or lesser severity occur, therefore, sometimes with severing of the ligaments.

Where they join the blade, certain knife handles have an enlargement which in certain cases can be used as a bearing point for the user's hand but it can in no way prevent the hand from sliding onto the cutting edge of the blade. In other words, there is little real protection. This state of the art can be illustrated by the teachings of patents GB 2171628 and EP 0283445.

SUMMARY OF THE INVENTION

The problem addressed by the invention is how to protect the fingers of the hand of the user holding the knife handle in a simple, safe, effective and efficient manner by making it impossible for the hand to slide onto the cutting edge of the blade. It was also felt important to take into account the problem of the positioning of the cutting edge of the blade, which must be as low as possible for a given work surface. The dimensions of the blade, particularly its length, thickness and height, are of course dictated by directives depending directly on the nature of the work to be carried out.

To solve these various problems, a cutting implement of the type comprising, in a manner known per se, a fixed blade integral with a handle that has features, in the vicinity of the interface between it and the blade, such as to protect the fingers of the user from the cutting edge of the said blade, has been devised and developed.

The problem of how to provide effective and certain protection of the user's fingers is solved in that the features of the handle are a hooked profile formed very roughly in the thickness and continuation of the interface between the handle and the blade to give a part that is bent away from the blade in the general form of a C so as to protect at least two fingers while leaving the others free.

To solve the problem of how to provide protection for the fingers of the hand while at the same time having the C-shaped objective of enabling the handle to be released very easily if necessary, the C-shaped profile defines an open inner loop comprising, on the outside, a straight segment extending roughly parallel to the straight upper edge of the handle and is joined to the interface of the handle by a straight segment set at an angle in order to allow the user always to incline the blade with respect to a given work surface in order to allow a sufficient length of contact for the cutting edge.

With this conception as the basis, either the hooked profile is situated roughly in line with the cutting edge of the blade, or roughly in line with the back of the blade.

To solve the problem of the positioning of the cutting blade with respect to the work surface, the blade is set low and inclined with respect to the upper edge of the handle so as to position the cutting edge of the said blade as close as possible to a work surface.

To solve the problem of lowering the cutting edge of the blade with respect to a work surface, particularly at the attacking portion of the blade, that is to say its free end, the angle at which the blade joins the handle is roughly between 5° and 25°. The angle at which the blade is joined is preferably 10°.

The handle and the protective hooked profile are produced together by plastic injection molding.

BRIEF DESCRIPTION OF THE DRAWINGS

The invention is described below in greater detail with the aid of the figures of the attached drawings in which.

DETAILED DESCRIPTION OF THE INVENTION

Following well-known practice, the knife comprises a blade (1) attached to a handle (2). The blade (1) is attached to the handle (2) by any appropriate known means in a fixed angular position to form a non-folding knife. The reference (la) indicates the back of the blade and (1*b*) its cutting edge.

In accordance with a basic characteristic of the invention, the handle (2) comprises, in the vicinity of the interface (2*a*) between it and the blade (1), a hooked profile (2*b*) acting as an open underguard that protects the fingers of the user. The profile (2*b*) is formed very roughly in the thickness and continuation of the interface (2*a*) between the handle and the blade. The profile (2*b*) defines an open inner loop (2*b*1) very roughly in the shape of a C. On the outside, the hooked profile (2*b*) comprises a straight segment (2*b*2) extending roughly parallel to the straight upper edge (2*c*) of the handle. This straight segment (2*b*2) is joined to the interface (2*a*) of the handle by a straight segment (2*b*3) set at an angle in order to allow the user always to incline the blade with respect to a given work surface, in order to allow a sufficient length of contact for the cutting part (1*b*) of the said blade.

To solve the problem of how to position the cutting edge (1*b*) of the knife blade as close as possible to the work surface in question, and in view of the standard dimensions of blades, the whole of the blade (1) is set lower than the upper edge (2*c*) of the handle (2). The angle at which the blade (1) joins the handle (2) is between 5 and 25°. Advantageously, this angle is preferably 10°.

These combined arrangements of the positioning of the blade (1) with respect to the handle (2) with the protective hooked profile (2*b*) allow the knife to continue to be used in a conventional way as regards the actual cutting action, whilst at the same time providing effective protection for the fingers of the user by making it impossible for the hand to slide towards the cutting edge (1*b*) of the blade.

It will be seen, too, that the protective hooked profile (2*b*) is open so that the hand is not trapped on the handle and can escape from the handle automatically if necessary.

Figure 1:
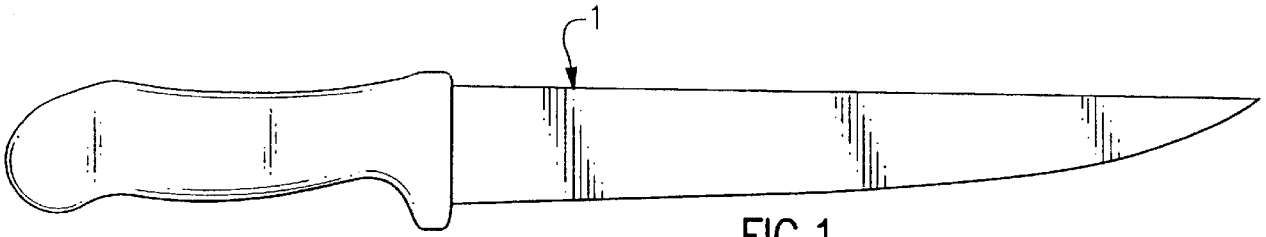
FIG.1 Prior Art
FIG. 1 is a front view of an example of an embodiment of a cutting knife according to the prior art.
Figure 2:
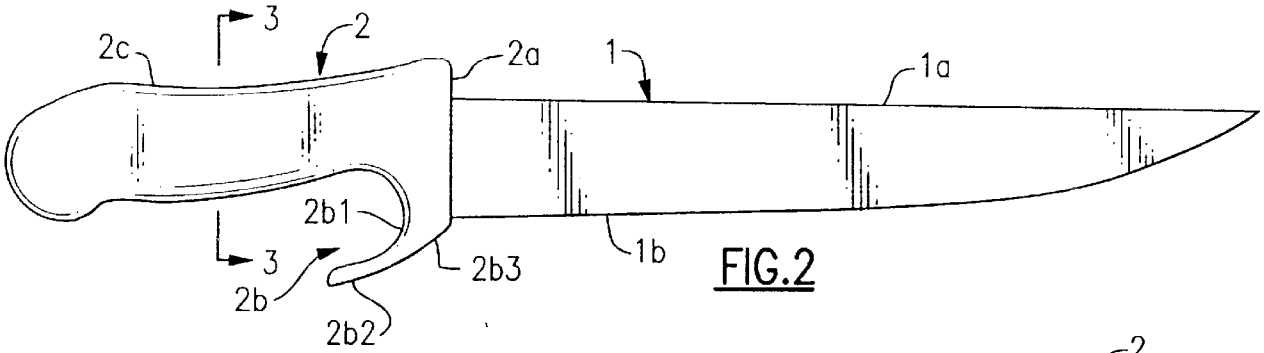
FIG. 2 is a view corresponding to FIG. 1, showing the same type of knife as that illustrated in FIG. 1 and produced in accordance with the characteristics of the invention.
Figure 4:
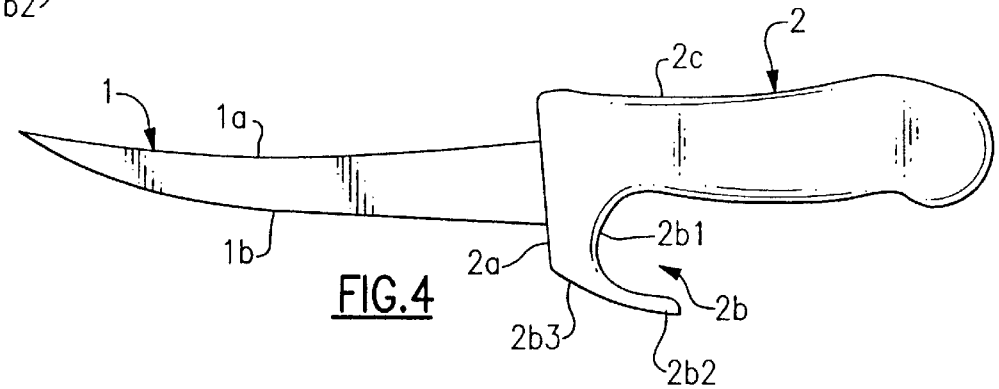
FIG. 4 is a front view showing another type of knife in accordance with the characteristics of the invention.
Figure 3:
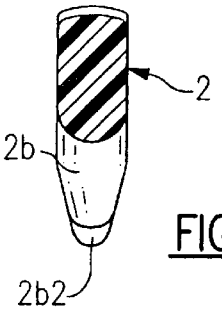
FIG. 3 is a view corresponding to the line 3.3 in FIG. 2.

The invention applies to knife blades of all kinds (straight or curved) (FIGS. 2 and 4) depending on the intended application. Likewise the cutting edge (1*b*) of the blade may be of any profile. The blade itself, therefore, continues to be made in the known way as regards form, dimensions and characteristics. Only its position with respect to the handle is modified, both as regards height and as regards inclination.

The handle (2) and the protective hooked profile are together advantageously made by plastic injection molding.

The invention is applicable to knives of all kinds, particularly those use in the agrofoodstuffs industry, for slaughtering, cutting up meat and cutting certain vegetables such as lettuces and cauliflowers, without however excluding other applications in the domestic sphere.

It should be observed also that the protective profile can be sited where required for the intended application, roughly in line with the back of the blade or roughly in line with both the cutting edge and with the back of the blade.

The advantages will be clear from the description. In particular it is worth repeating and underlining the safe and effective protection of the fingers of the user's hand without however any modification to the cutting characteristics resulting in particular from the way the knife is used.

What is claimed is:

1. A cutting implement comprising a fixed blade (1) having a cutting edge (1*b*) and an opposed back edge (1*a*) said blade being integral with a handle (2) that has features (2*b*) in the vicinity of an interface (2*a*) between the handle and the blade to protect fingers of a user from the cutting edge, the features of the handle are a C-shaped part defining an open inner loop (2*b*1) comprised on the outside, a first straight segment (2*b*2) extending roughly parallel to a straight upper edge (2*c*) of said handle and being joined at the interface by a second straight segment (2*b*3) that is set at an angle with respect to the first straight segment to allow the user to incline the blade with respect to a work surface, said C-shaped part being formed roughly in the thickness and continuation of the interface between the handle (2) and the blade (1) to protect two fingers while leaving the other fingers free.

2. Implement according to claim 1, characterized in that the blade (1) is set low and inclined with respect to the upper edge (2*c*) of the handle (2) so as to position the cutting edge (1*b*) of the said blade (1) as close as possible to a work surface.

3. A cutting implement according to claim 1 wherein the C-shaped part is roughly in line with the cutting edge of the blade (1).

4. A cutting implement according to claim 1 wherein the C-shaped part is situated roughly in line with the back edge of the blade.

5. A cutting implement according to claim 1 tho C-shaped part is situated roughly in line with both the cutting edge and the back edge of the blade.

6. Implement according to claim 1, characterized in that the angle at which the blade (1) joins the handle (2) is roughly between 5° and 25°.

7. Implement according to claim 6, characterized in that the angle at which the blade is joined is preferably 10°.

8. A cutting implement according to claim 1 the handle and the C-shaped part are produced together by plastic injection molding.

9. A cutting implement having a blade with a cutting edge and a top edge that is integrally joined to a handle to form an interface therebetween, said handle having a straight upper edge and further includes a C-shaped part that is formed about to the thickness and continuation of the interface, said C-shaped part opening away from the blade for protecting at least two fingers of a user's hand and wherein said C-shaped part has a first straight segment extending parallel to the straight upper edge of the handle and a second straight segment set at an angle with respect to said first straight segment to permit the blade to be inclined with regard to a work surface.

10. The implement of claim 9 wherein the cutting edge of the blade is inclined with respect to the upper edge of the handle.

11. The implement of claim 9 wherein the cutting edge of the blade is in a plane that passes through the C-shaped part of the handle.

12. The implement according to claim 9 wherein the first segment of tho C-shaped part is generally parallely aligned with the cut edge and the top edge of the blade.

13. The implement of claim 9 wherein said blade forms an angle of between 5° and 25° with the handle at said interface.

14. The implement of claim 9 wherein said blade forms an angle of about 10° with said handle.

15. The implement of claim 9 wherein said handle and said C-shaped part are integrally molded of plastic.

* * * * *

UNITED STATES PATENT AND TRADEMARK OFFICE

CERTIFICATE OF CORRECTION

PATENT NO. : 6,460,255 B1
DATED : October 8, 2002
INVENTOR(S) : Dassaud

It is certified that error appears in the above-identified patent and that said Letters Patent is hereby corrected as shown below:

Column 3,
Line 41, after the number "(1a)", please insert a comma -- , --.

Column 4,
Line 12, at the end of the sentence before "C-Shaped", please delete "tho" in place of -- the --.
Line 44, after the phrase "segment of" please delete "tho" in place of -- the --, and
Line 45, after the phrase "with the" please delete the word "cut" in place of -- cutting --.

Signed and Sealed this

Twenty-eighth Day of January, 2003

JAMES E. ROGAN
*Director of the United States Patent and Trademark Office*